US007293396B1

(12) United States Patent
Cunningham

(10) Patent No.: US 7,293,396 B1
(45) **Date of Patent: *Nov. 13, 2007**

(54) METHOD OF CONNECTING A TOP TO A CONTAINER

(76) Inventor: Kelly W. Cunningham, 12158 Lawler St., Los Angeles, CA (US) 90066

( * ) Notice: Subject to any disclaimer, the term of this patent is extended or adjusted under 35 U.S.C. 154(b) by 217 days.

This patent is subject to a terminal disclaimer.

(21) Appl. No.: 11/153,803

(22) Filed: Jun. 14, 2005

Related U.S. Application Data

(63) Continuation-in-part of application No. 10/678,473, filed on Oct. 3, 2003, now Pat. No. 6,968,965.

(51) Int. Cl.
*B67B 3/20* (2006.01)

(52) U.S. Cl. ..... 53/490; 53/317; 53/331.5

(58) Field of Classification Search ..... 53/490, 53/317, 331.5, 332
See application file for complete search history.

(56) References Cited

U.S. PATENT DOCUMENTS

| | | | | | |
|---|---|---|---|---|---|
| 1,582,682 | A | | 4/1926 | Hammer | |
| 2,312,513 | A | | 3/1943 | Wilson | 215/43 |
| 2,326,809 | A | | 8/1943 | White | 215/44 |
| 2,752,060 | A | | 6/1956 | Martin | 215/41 |
| 2,963,837 | A | * | 12/1960 | Dimond | 53/67 |
| 3,077,280 | A | | 2/1963 | Foss et al. | 215/44 |
| 3,323,672 | A | | 6/1967 | Acton | 215/44 |
| 3,690,496 | A | | 9/1972 | Gibson | 215/9 |
| 3,695,475 | A | | 10/1972 | Ruekberg | 215/9 |
| 3,794,200 | A | | 2/1974 | Marks | 215/9 |
| 3,923,181 | A | | 12/1975 | Libit | 215/224 |
| 3,955,696 | A | | 5/1976 | Finke | 215/214 |
| 4,156,490 | A | * | 5/1979 | Peraboni | 215/252 |
| 4,210,251 | A | * | 7/1980 | Grussen | 215/329 |
| 4,298,129 | A | | 11/1981 | Stull | 215/224 |
| 4,308,707 | A | * | 1/1982 | Willingham | 53/314 |
| 4,412,409 | A | * | 11/1983 | Aichinger et al. | 53/485 |
| 4,561,553 | A | | 12/1985 | Crisci | 215/256 |
| 4,712,699 | A | | 12/1987 | Lutz | 215/329 |
| 4,807,770 | A | * | 2/1989 | Barriac | 215/252 |
| 4,946,055 | A | | 8/1990 | Towns et al. | 215/254 |
| 4,984,699 | A | * | 1/1991 | Zalut | 215/231 |
| 5,054,260 | A | * | 10/1991 | Herzog | 53/307 |
| 5,054,268 | A | * | 10/1991 | Hayes et al. | 53/490 |
| 5,464,110 | A | * | 11/1995 | Heyworth | 215/223 |
| 5,551,582 | A | | 9/1996 | Robinson | 215/216 |
| 5,720,402 | A | | 2/1998 | May | 215/252 |
| 5,829,609 | A | | 11/1998 | Beck | 215/217 |
| 5,913,437 | A | | 6/1999 | Ma | 215/252 |
| 6,105,802 | A | | 8/2000 | French et al. | 215/318 |
| 6,702,134 | B2 | | 3/2004 | Scalese et al. | 215/344 |
| 6,968,965 | B1 | * | 11/2005 | Cunningham | 215/44 |

* cited by examiner

FOREIGN PATENT DOCUMENTS

| | | |
|---|---|---|
| DE | DE 10128597 | 2/2002 |

*Primary Examiner*—Stephen F. Gerrity
(74) *Attorney, Agent, or Firm*—Cislo & Thomas LLP; Kelly W. Cunningham, Esq.

(57) ABSTRACT

A threaded container closure assembly in which the container comprises one or more radially extending members proximate the distal end thereof that initially engage with one or more radially extending members or partial radially extending members on a mating closure or top proximate the distal end thereof so that the container and top become at least partially interconnected and are thereby not too easily and inadvertently separated while the user attempts to cause engagement of the threads for screwing down the top onto the container.

19 Claims, 4 Drawing Sheets

METHOD OF CONNECTING A TOP TO A CONTAINER

CROSS REFERENCE TO RELATED APPLICATIONS

This application is a continuation-in-part of U.S. application Ser. No. 10/678,473, filed Oct. 3, 2003, now U.S. Pat. No. 6,968,965.

BACKGROUND OF THE INVENTION

This invention relates to screw threaded connectors, and more particularly to threaded containers and mating caps, lids, and the like.

Screw-type threaded container closures are a well-known method for joining a container to a lid, cap, or other top. Typically, the open end of the container is threaded for receiving a mating threaded closure top. When the top or the container is slippery, one or the other component can slip out of a person's hands. When this happens, the simple task of screwing down a lid is made more difficult and time consuming. If the lid is dropped, it may become soiled or even broken or dented beyond use. If the container is dropped, the whole container may be spilled, broken, or otherwise damaged. Consequently, a person mindful of this concern may take undue time and attention to carefully screw the lid down onto the container.

Also, under many circumstances, the user may prefer to use only one hand to screw the lid down on a container—when the user's hands are otherwise full or the user is preoccupied by other matters, for example. Where the container is fixed or where its weight is sufficient to resist rotating or other movement when it encounters the normal forces exerted on it by the user during the twisting action of screwing down the lid, it may be more convenient and more efficient for the user to screw the lid down simply using one hand, freeing the other hand for other more important matters. Under such circumstances, however, the user may lose the interconnection between lid and container causing the lid to slip off center or slip out of the user's hand, or causing the container to move. Consequently, a person mindful of these annoyances will sometimes use two hands even if this is less convenient and less efficient than simply using one hand.

Additionally, sometimes the threads of a lid are poorly designed or for some other reason not easily engaged with the threads of the container. In these instances, the chances of the user losing his or her grip on either the lid or the container are greatly increased. Also in such instances the operator may find that he or she cannot simply use one hand to screw down the lid at all. In other instances, the user may have a disability of some kind (e.g., arthritis, poor muscle control, poor sight, etc.) and therefore finds it difficult to maneuver a top down onto a container opening with presently available threaded container closure products.

If, however, there was a mechanism that preliminarily connected the container and the lid, the user could attempt to engage the threads without the additional worries of losing his or her grip of the lid or container and may also feel free to screw the lid down with just one hand. Thus, what is needed in a threaded container and mating lid is a mechanism to initially at least partially interlock or interconnect the two so that they are not too easily and inadvertently separated while the user is attempting to cause engagement of the threads for screwing down the lid onto the container.

SUMMARY OF THE INVENTION

The present invention involves a threaded container closure assembly in which the container comprises one or more radially extending members proximate the distal end thereof that engage with one or more radially extending members on a mating closure or top proximate the distal end thereof so that the container and top become at least partially interlocked or interconnected and thereby are not too easily and inadvertently separated. In a preferred embodiment, this partially interlocked arrangement also causes the top to be aligned with the container.

In one embodiment, the partial interlocking and alignment may themselves serve the user's immediate closure needs, both functionally and aesthetically, such that the user would not have to attempt to screw down the top onto the container each time to obtain a satisfactory closure. In this embodiment, this partial interlocking and alignment may also function to assist the user if the user further elects to engage the threads of the top and container to screw down the top onto the container.

In another embodiment, the tolerances between container and top are such that only the top or only the container would comprise one or more radially extending members, but not both. In this embodiment, the radially extending members would then engage the surface of the other component to provide a sufficient interconnection to align the components and hold them together to make easier the act of screwing the two components tight.

These and other advantages of the present invention will be apparent from a review of the following specification and accompanying drawings.

DETAILED DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and methods may be accomplished by different embodiments that are also intended to be encompassed within the spirit and scope of the invention.

Figure 1:
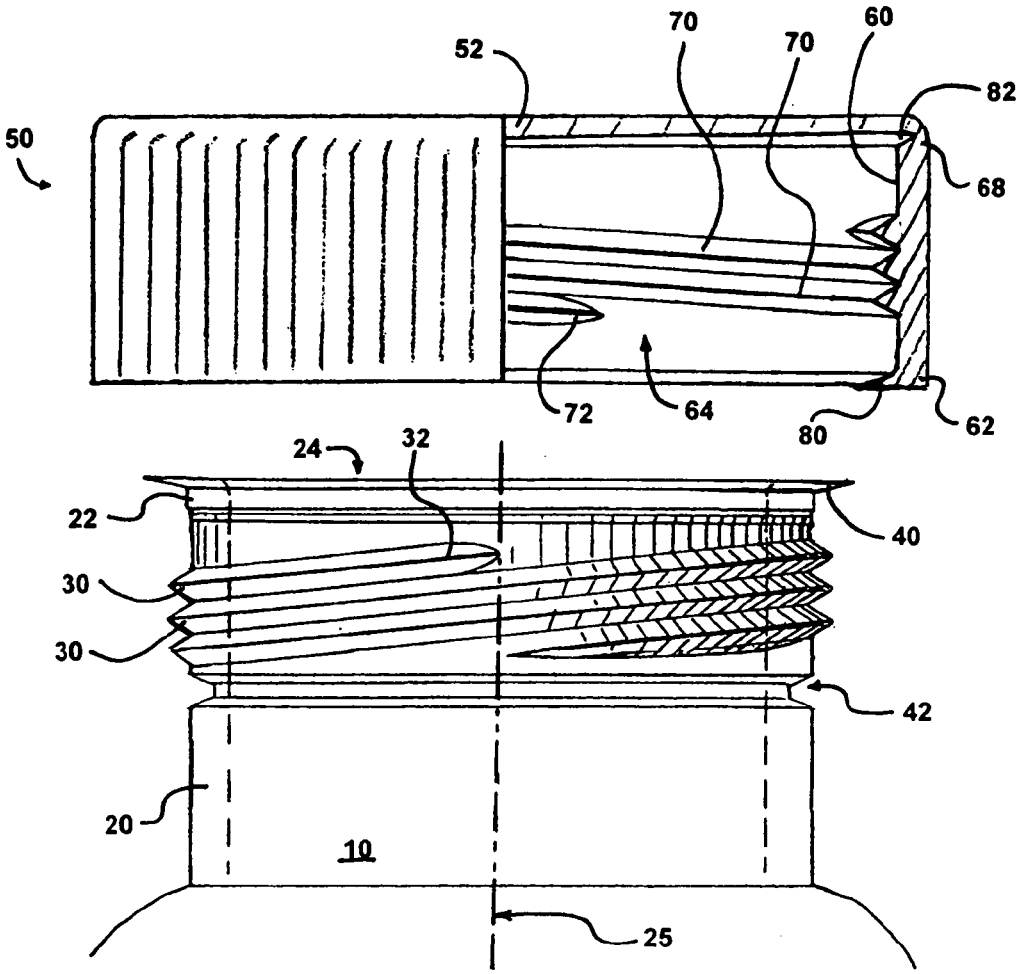
FIG. 1 is an exploded side elevation view of a threaded container opening and top in keeping with one embodiment of the present invention wherein a portion of the top has been removed for illustration purposes.
Figure 2:
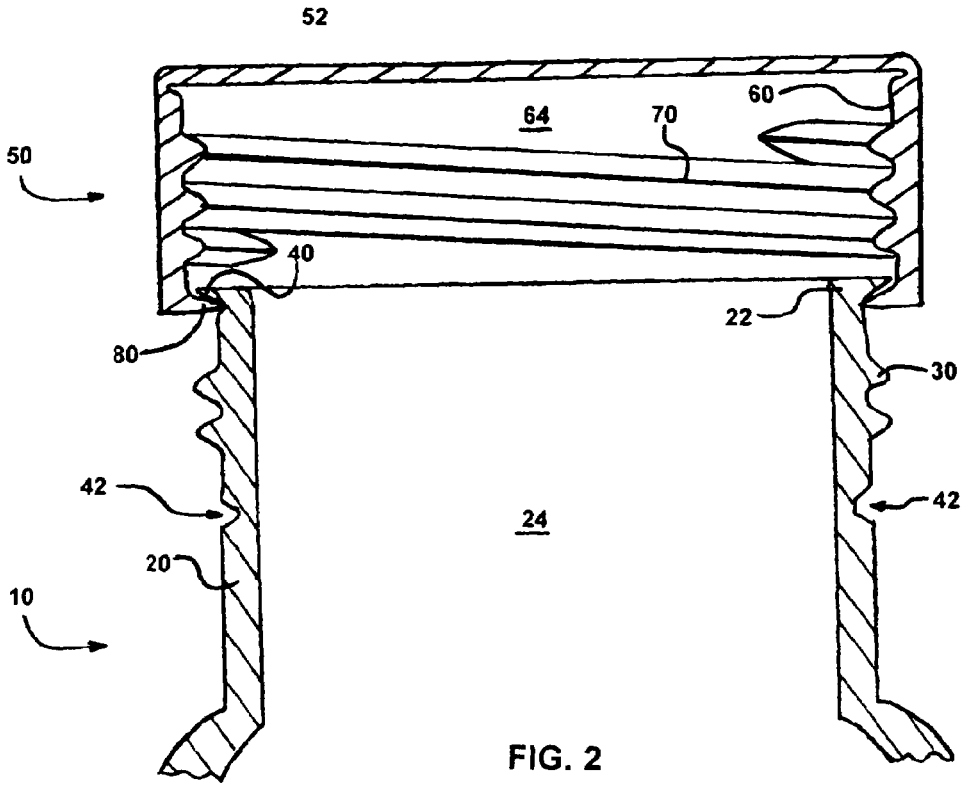
FIG. 2 is an exploded side elevation view of the container and top of FIG. 1 wherein the radially extending members of the top have been pressed just past the radially extending members of the threaded container opening.
Figure 3:
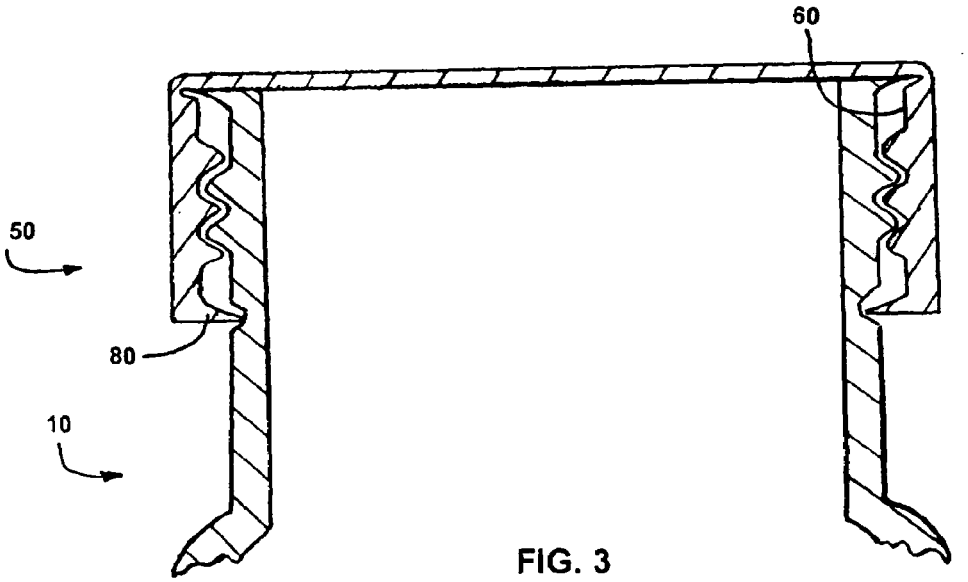
FIG. 3 is an exploded side elevation view of the container and top of FIG. 1 wherein the top has been fully screwed down onto the container.
Figure 4A:
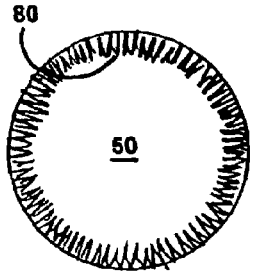
FIGS. 4*a* through 4*e* are top plan views of container openings in keeping with the present invention illustrating a few different embodiments of the one or more radially extending members formed on distal end portions of the container openings.
Figure 4B:
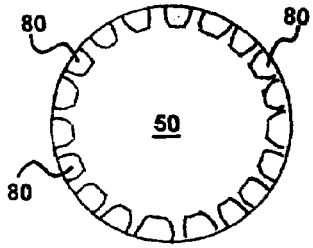
Figure 4C:
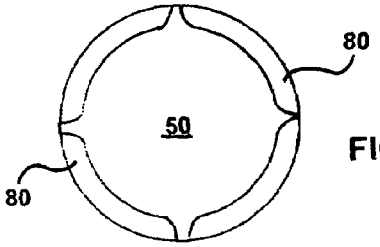
Figure 4D:
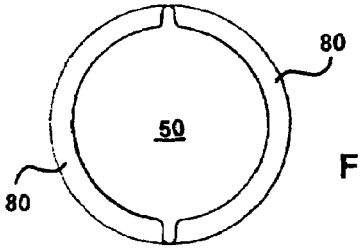
Figure 4E:
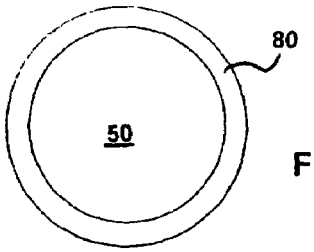
Figure 5A:
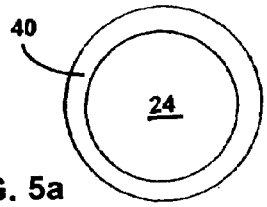
FIGS. 5*a* through 5*e* are bottom plan views of closures, lids, caps, or tops in keeping with the present invention illustrating a few different embodiments of the one or more radially extending members formed on a distal end portions of the tops.
Figure 5B:
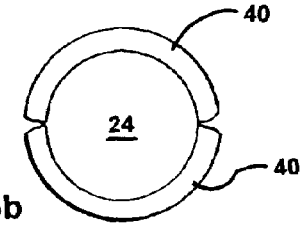
Figure 5C:
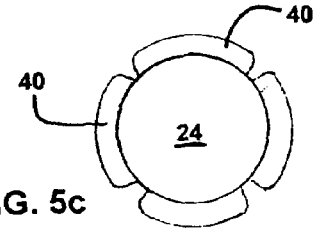
Figure 5D:
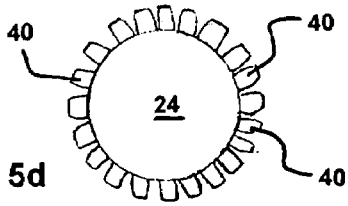
Figure 5E:
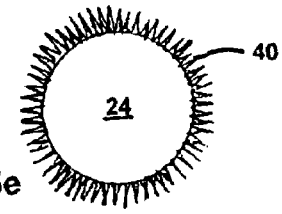

FIGS. 1 through 3 illustrate one embodiment of the present invention, in which there is a container 10 comprising at one end a generally annular sidewall 20 having a distal end 22 that defines an opening 24 having centerline 25. The container 10 further comprises screw-type threads 30 formed near the distal end 22 and one or more radially extending members 40 disposed at the threads 30 or between the threads 30 and the distal end 22. In one embodiment of the present invention, the radially extending members 40 are configured to extend away from the centerline 25 roughly the same distance as the radial extent of threads 30. In another embodiment of the present invention, the radially extending members 40 are configured to extend further away from the centerline 25 than the radial extent of threads 30.

A mating top 50 comprises a base 52 and a central recess defined by a generally annular inner wall 60. The inner wall 60 distends from the base 52 to a distal end 62. Screw-type threads 70 are formed on the inner wall 60 configured to engage the screw-type threads 30 of the container 10. The inner wall also comprises one or more radially extending members 80 disposed proximate the distal end 62 of the inner wall 60.

When a user wants to tighten a top 50 onto a mating container 10 in keeping with the present invention, a user places the top 50 on the container 10 such that distal end 62 of the top is near or touching the distal end 22 of the container and the top 50 is roughly centered and concentric about the centerline 25 of the opening 24. Then, the user presses the top down onto the container using a slight amount of force so that some or all of the one or more radially extending members 80 of the top 50 move past some or all of the one or more radially extending members 40 of the container 10. The top 50 and the container 10 are thereby partially and preliminarily interlocked or interconnected in such a way that the top and the container are not too readily and inadvertently dissociated from one another. Another beneficial result of this preliminary interconnection is that the top 50 and container 10 are aligned and properly positioned for the next step of screwing the top 50 down onto the container 10.

That is, at this point, the top 50 is interlocked or interconnected only preliminarily to the container 10. There are two immediate benefits of this preliminary connection. First, the connection is sufficient to assist the user when the user attempts to align the top 50 with the container 10 and to engage the threads 30 of the container with the mating threads 70 of the top 50. Second, the connection may, in many instances, be a sufficient connection for the desired purpose. These two benefits are discussed in turn.

First, as a result of the preliminary interconnection between container and top afforded by the fact that some or all of radially extending members 80 have been pressed past some or all of radially extending members 40, the user can work to engage the threads 30 of the container 10 with the threads 70 of the top 50 with the added assurance that, until the threads are engaged, the container 10 and top 50 are not likely to become inadvertently separated. In some embodiments, the interaction between the radially extending members of one component (for example, the top 50) and the radially extending members or the surface of the annular side wall of the other component help to center the top 50 over the container opening 24 and maintain alignment of the top 50 concentrically about the centerline 25 of the opening 24. One consequence of this is that the user can more reliably attempt to engage the threads 30 of the container 10 and the threads 70 of top 50 with less effort and less concern that the two components will be inadvertently separated or that the threads 70 of the top 50 will fail to properly engage the threads 30 of the container 10 through misalignment.

FIGS. 4*a* through 7 illustrate a number of radially extending members 40 and 80 in keeping with the present invention. The illustrated configurations do not constitute an exhaustive or exclusive list of the contemplated possible configurations, but are instead provided as a few examples of radially extending members 40 and 80 for discussion purposes only. The inventor equally contemplates other configurations. FIGS. 4*e* and 5*a* illustrate simple flange configurations in which the single radially extending member 80 of the top 50 extends in the radially inward direction and the single radially extending member 40 of the container 10 extends radially outward. This may, of course, be reversed in closure assemblies in which the threads of the container are formed on the inside surface of the container 10 and the top 50 is configured like a plug to fit partially within the annular sidewall 20 of the container 10 (not shown).

The remaining examples of FIGS. 4*a* through 5*e* illustrate containers and tops that have more than one radially extending members 40 and 80, respectively. The gaps between the plurality of radially extending members can be beneficial in that they can allow the threads of the other component to pass by the radially extending members without deforming the radially extending members as much as in closure assemblies having a single continuous flange-like radially extending member.

Figure 6:
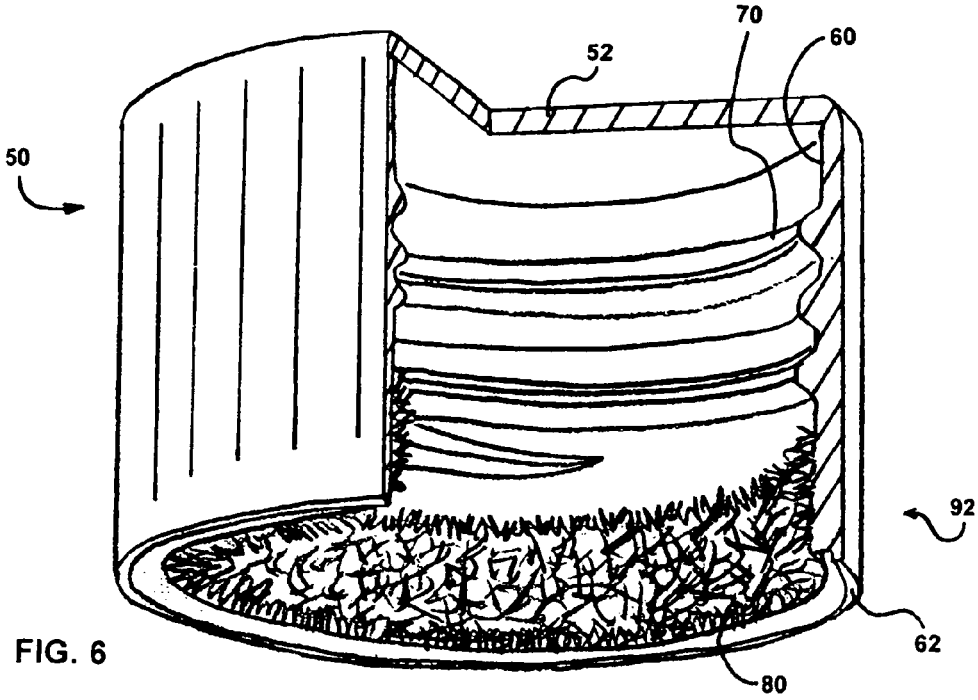
FIG. 6 is a perspective view of a top having another type of radially extending members in keeping with one embodiment of the present invention.
Figure 7:
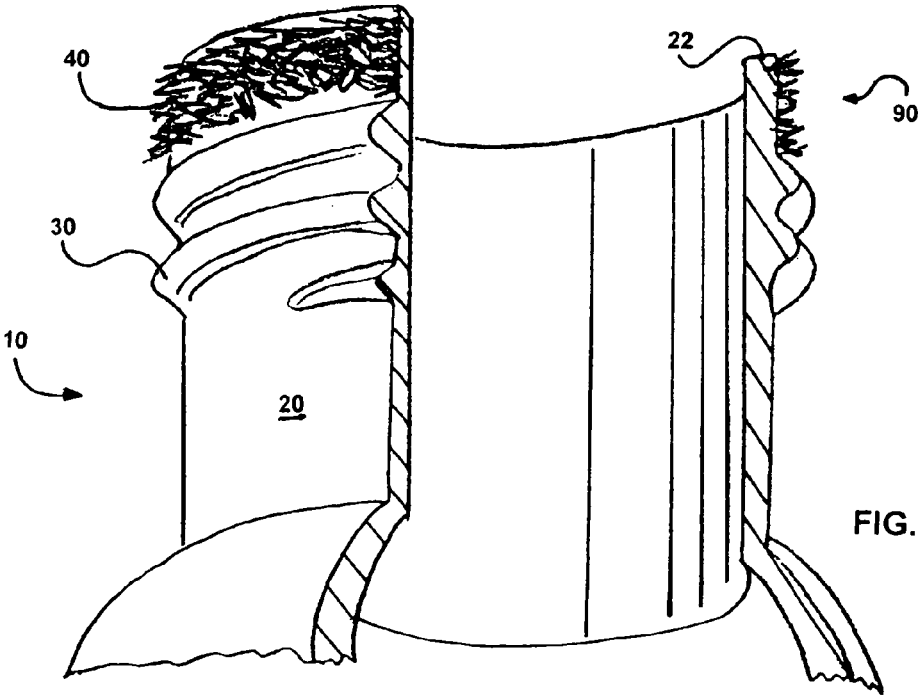
FIG. 7 is perspective view of a container opening having another type of radially extending members in keeping with one embodiment of the present invention.

FIGS. 6 and 7 illustrate other embodiments in which there is more than one row of radially extending members near the distal end of the container or top creating active regions of interconnection 90 and 92, respectively. Both of the components may have multiple rows of radially extending members as shown in FIGS. 6 and 7, or one or the other component may have only a single row of radially extending members as shown in FIGS. 4*a* through 5*e*. In either case, the active region of interconnection in one or both of the components can further assist the user in properly orienting and aligning the top about the centerline 25 of the opening 24, as well as hold the top 50 onto the distal end 22 of the container 10 so that the top and container are not too easily inadvertently separated while the user attempts to engage the threads 30 of the container 10 with the threads 70 of the top 50.

As can be seen in FIGS. 4 through 7, while any number of radially extending members 40 and 80 are contemplated within the scope of the invention, in a preferred embodiment, the radially extending members 40 and/or 80 are dispersed roughly evenly about the circumference of the respective distal ends 22 and/or 62. This insures that the top 50 will seat roughly evenly and stably in alignment concentrically about the centerline 25 of opening 24 of container 10. In a preferred embodiment, the radially extending members 40 or 80 number three or more dispersed somewhat evenly about the circumference. As a result, the top 50 will rest on the container in this preliminary or intermediate position with at minimum three points of contact, thereby insuring that the top will seat evenly about the distal end of the container 10 with the stability of a tripod stand. The top 50 would consequently not wobble about the opening 24 of the container 10, and instead would provide a quite satisfactory temporary closure for many situations, as discuss above. In fact, in one embodiment of the present invention, the radially extending members 40 and/or 80 extend axially as well as extending about the circumference as shown in FIGS. 6 and 7. In embodiments in which there are radially extending members on only one of the components, they may be configured to be sufficiently flexible so as to flexibly engage the surface of the distal end of the other component in a temporary friction-fit manner. Just as discussed above, this arrangement reduces the degrees of freedom on movement to the axial direction alone, insuring that the top 50 will be seated on the container in a stable and concentrically aligned fashion. The result is a temporary closure that is quite sufficient for many applications in a user's daily routine, such as a tube of toothpaste in a medicine cabinet, as just one example. Other jars, tubes, bottles, etc. can also readily benefit from such a temporary, intermediate closure, and the user can elect either to leave the container and top in this temporary closure arrangement until the next time the container must be opened, or to take the next step of tightening the top down on the container by engaging the threads on both.

In an alternative embodiment, such as those shown in FIGS. 4*d* through 5*b* for example, there may be only one or two radially extending members, so long as combined they span a sufficient amount of the circumference of the distal end of container 10 or top 50, and preferably at least approximately one third of the circumference, and more preferably at least approximately half of the circumference. The importance of this span is to provide the top 50 with enough of a seat about the circumference of the distal end 22 of the container 10 to maintain concentric alignment between the top 50 and the container 10, keeping the top from wobbling significantly from side to side in this intermediate or temporary connection state. This provides a degree of comfort aesthetically to the user when applying the top 50 for only a temporary connection described above rather than completely tightening the top 50 down onto the container 10. This also provides a stable and durable, albeit temporary, closure when placed in this temporary connection state. Finally, this adds to the convenience to the user who thereafter elects to proceed to tighten the top down onto the container since the threads 30 of the container are more easily and readily engaged by the threads 70 of the top because of this concentric alignment of top 50 about the centerline 25 of the opening 24 of the container 10.

Additionally, the radially extending members 40 and 80 accordingly could take the form of any number of appendages, including flanges, discrete flange segments, short filaments, rods, spars, axially-oriented detents, lugs, hoops, loops, hook members, latch members, or the like. The radially extending members could also take the form of a texture or slight roughness on the surface of the sidewall or inner wall or one or more points where the surface of the sidewall or inner wall itself flares out slightly. It is contemplated that the radially extending members could be made of any resilient material, including the same material as the container or top upon which they are formed or affixed, but also including any other suitable material, such as a soft or hard elastomer, polymeric materials, metal, wood, coarse fibers, and the like.

In a preferred embodiment, the radially extending members 80 are more flexible than the distal end 62 of the top 50. Similarly, in a preferred embodiment, the radially extending members 40 are more flexible than the distal end 22 of the container 10. As a result, neither the distal end 62 of top 50 nor the distal end 22 of the container 10 need to be deformed or distorted at any point in this method in order to press the respective radially extending members past each other or past the threads of the top or container.

With respect to this first benefit of the present invention, it should be understood that the radially extending members 40 and 80 could be placed at any point near the distal ends 22 and 62 of the container 10 and of the top 50, respectively. Certain plastic extrusion processes, plastic mold finishing methods, and press sintering techniques, for example, may benefit particularly from forming the radially extending members at or very near the distal ends because this may, among other things, require fewer changes to existing molds, less revamping or retrofitting of existing finishing techniques, and the like. This placement may also make the benefits of the present invention more evident to the consumer or make it less difficult to market or advertise to the consumer the advantages of the present invention.

On the other hand, however, placement of the radially extending members 40 and 80 very near, at, or even just past the beginnings (i.e., the distal-most portions) of the threads 30 of the container 10 and/or the threads 70 of the top 50 could make the next step of engaging the threads of the container and top much simpler or even automatic for the user. That is, when the beginning threads 32 of the container 10 are proximate to the radially extending members 40 of the container 10, once the user presses the radially extending members 80 of the top 50 past the radially extending members 40 of the container 10, the user will not have to apply any further axial force in order to get the beginning threads 72 of the top 50 to engage the beginning threads 32 of the container 10. The user therefore is offered a simple two-step closure method: tap (or snap or press) and twist.

If in fact the beginning threads 32 of the container 10 are immediately proximate or even extend just beyond the radially extending members 40 of the container 10, this positioning can cause the top 50 to instantaneously rotate into place at the moment the user presses or snaps the radially extending members 80 of the top 50 past the radially extending members 40 of the container 10 (i.e., when the beginning threads 72 of the top 50 are also somewhat close to the radially extending members 80 of the top 50). This action would thereby initiate the screwing down of the top 50 onto the container 10, offering the user a virtually one-step closure method and greatly simplifying the application of the top to the container for the user.

Moreover, where the tolerances between the container and the top are particularly small, the radially extending members of the top or of the container can act directly upon the mating surface of the other mating component without the need for radially extending members on the other component. In such embodiments, the contact between the radially extending members and this mating surface of the other component itself will have the previously discussed effect of causing the container and the top to be preliminarily interlocked or interconnected and aligned so that inadvertent separation of the two is avoided while the user attempt to engage the threads and screw down the top onto the container.

Secondarily, the preliminary connection between container 10 and top 50 created by the interaction between the respective radially extending members 40 and 80 may be a sufficient connection for many circumstances. A user may not want or need to completely screw down a top onto a tube of toothpaste, for example, each morning. In such circumstances, the radially extending members 40 and/or 80 can act as a simple snap closure alternative to the more secure closure available through engaging the screw-type threads 30 and 70. In some embodiments, the simpler snap alternative can in fact act as a Velcro®-like hook-and-loop closure for the container industry, such as the embodiments illustrated in FIGS. 6 and 7, under those numerous circumstances where such a temporary connection would be perfectly acceptable—or at least perfectly acceptable some of the time.

In one embodiment of the present invention, the container has one or more annular recesses 42 for receiving the radially extending members 80 of the top 50 when the top 50 is fully screwed down onto the container 10. Similarly, top 50 may have one or more annular recesses 82 for receiving the radially extending members 40 of the container 10. In this embodiment, therefore, the shape of the radially extending members 40 and 80 of the container and top, respectively, may be preserved and not deformed during long periods in which the top is fully screwed down onto the container, although it is not necessarily the case that the radially extending members 40 and 80 would otherwise become deformed during long period in which the top 50 and container 10 are screwed tight. Some of the configurations of the radially extending members 40 and 80 illustrated herein or otherwise within the intended scope of the present invention understandably resist becoming deformed under such circumstances, such as when the radially extending members are made of an elastomeric material or some other sufficiently flexible and resilient material, or when the radially extending members are spaced apart or notched so as to avoid the threads and surface wall of the mating component. In other such configurations and ambient conditions, the radially extending members 40 and 80 could benefit from the added protection from becoming deformed by, for example, providing recesses 82 and 42, respectively.

The foregoing discussion of the present invention utilized a threaded container 10 and mating lid or top 50 for illustration purposes only. Yet other assemblies are equally contemplated in the present invention. Plumbing applications, hoses, pipes, and tubes, for example, can all benefit from the innovative aspects of the present invention. Each of these applications can advantageously employ paired radially extending members 40 and 80 on their threaded male and female components to afford an intermediate preliminary interconnection between the components that assists the user in aligning the components and holding them together while the user attempts to engage the threaded features of the components for screwing the two components tight.

Similarly this innovative aspect of the present invention provides the described advantages to other components that are designed to be screwed down to a threaded post, such as commercial electronic components, cameras and tripods, threaded mounts and handles, nuts and bolts, and the like. In each instance, the male threaded component comprises at its threaded end one or more radially extending members, and the tapped female component comprises at or near its distal end one or more inwardly directed radially extending members. The user places the male and female components against one another and presses the female component over the male component such that the radially extending members of the female component press past the radially extending members of the male component. As a result, the male and female components are better aligned and are held together, thereby assisting the user while the user attempts to initiate screwing the threads of the female component down onto the male component. Also, in many such applications, the preliminary interconnection may work perfectly well to provide a sufficient connection between male and female components at least some of the time without the user having to resort to tightly screwing the two components to each other.

While the present invention has been described with regards to particular embodiments, it is recognized that additional variations of the present invention may be devised without departing from the inventive concept.

What is claimed is:

1. A method for temporarily connecting and thereafter securely tightening a top onto a container comprising:

placing a distal end of the top near a distal end of the container, pressing one or more radially extending members on the top down around the distal end of the container, thereby temporarily connecting the top to the container sufficiently to maintain the top in concentric alignment with the distal end of the container without allowing significant wobbling from side to side and to resist the chance that the top and the container will become inadvertently separated, thereafter securely tightening the top down onto the container without first separating the top from the container, and repeating the foregoing steps each time the end user wants to re-connect the top to the container thereby providing a user-friendly method of applying a top to a container, wherein said one or more radially extending members on the top are formed or affixed between the distal end of the top and threads formed on the top.

2. A method according to claim 1 wherein the step of securely tightening a top onto a container comprises engaging threads formed on the container with threads formed on the top, and thereby screwing the top down onto the container.

3. A method according to claim 2 wherein the container further comprises one or more radially extending members formed or affixed between the distal end of the container and the threads of the container.

4. A method according to claim 1 wherein said one or more radially extending members on the top number three or more.

5. A method according to claim 4 wherein the step of securely tightening a top onto a container comprises engaging threads formed on the container with threads formed on the top, and thereby screwing the top down onto the container.

6. A method according to claim 5 wherein the container further comprises one or more radially extending members formed or affixed between the distal end of the container and the threads of the container.

7. A method according to claim 1 wherein said one or more radially extending members on the top combined span at least approximately one third of the circumference of the distal end of the top.

8. A method according to claim 7 wherein the step of securely tightening a top onto a container comprises engaging threads formed on the container with threads formed on the top, and thereby screwing the top down onto the container.

9. A method according to claim 8 wherein the container further comprises one or more radially extending members formed or affixed between the distal end of the container and the threads of the container.

10. A method for temporarily connecting and thereafter securely tightening a top onto a container comprising:

placing a distal end of the top near a distal end of the container, pressing one or more radially extending members on the top down around the distal end of the container, thereby temporarily connecting the top to the container sufficiently to resist the chance that the top and the container will become inadvertently separated, thereafter securely tightening the top down onto the container without first separating the top from the container, and repeating the foregoing steps each time the end user wants to re-connect the top to the container thereby providing a user-friendly method of applying a top to a container, wherein said one or more radially extending members on the top are sufficiently flexible so that they permit being pressed past one or more radially extending members on the container without having to deform or distort the distal end of the top in the process.

11. A method according to claim 10 wherein said one or more radially extending members on the top number three or more.

12. A method according to claim 10 wherein said one or more radially extending members on the top combined span at least approximately one third of the circumference of the distal end of the top.

13. A method according to claim 10 wherein the step of securely tightening a top onto a container comprises engaging threads formed on the container with threads formed on the top, and thereby screwing the top down onto the container.

14. A method according to claim 13 wherein the container further comprises one or more radially extending members formed or affixed between the distal end of the container and the threads of the container.

15. A method for temporarily connecting and thereafter securely tightening a top onto a container comprising:

placing a distal end of the top near a distal end of the container, step for temporarily connecting the top to the container sufficiently to maintain the top in concentric alignment with the distal end of the container without allowing significant wobbling from side to side and to resist the chance that the top and the container will become inadvertently separated, thereafter securely tightening the top down onto the container without first separating the top from the container, and repeating the foregoing steps each time the end user wants to re-connect the top to the container thereby providing a user-friendly method of applying a top to a container.

16. A method according to claim 15 wherein said step for temporarily connecting the top to the container comprises either three or more radially extending members on the top and one or more radially extending members on the container, or one or more radially extending members on the top and three or more radially extending members on the container.

17. A method according to claim 15 wherein said step for temporarily connecting the top to the container comprises one or more radially extending members on the top that combined span at least approximately one third of the circumference of the distal end of the top.

18. A method according to claim 15 wherein the step of securely tightening a top onto a container comprises engaging threads formed on the container with threads formed on the top, and thereby screwing the top down onto the container.

19. A method according to claim 18 wherein the container further comprises one or more radially extending members formed or affixed between the distal end of the container and the threads of the container.

* * * * *